US011191360B2

(12) United States Patent
Hsieh

(10) Patent No.: US 11,191,360 B2
(45) Date of Patent: Dec. 7, 2021

(54) ARMREST STRUCTURE WITH ADJUSTABLE LIFTING FUNCTION

(71) Applicant: Wen-Ping Hsieh, Taichung (TW)

(72) Inventor: Wen-Ping Hsieh, Taichung (TW)

( * ) Notice: Subject to any disclaimer, the term of this patent is extended or adjusted under 35 U.S.C. 154(b) by 0 days.

(21) Appl. No.: 17/121,671

(22) Filed: Dec. 14, 2020

(65) Prior Publication Data

US 2021/0315382 A1 Oct. 14, 2021

(30) Foreign Application Priority Data

Apr. 10, 2020 (TW) ..... 109204222

(51) Int. Cl.
*A47C 1/03* (2006.01)

(52) U.S. Cl.
CPC ..... *A47C 1/0303* (2018.08)

(58) Field of Classification Search
CPC ..... A47C 1/03; A47C 7/541
USPC ..... 297/411.36
See application file for complete search history.

(56) References Cited

U.S. PATENT DOCUMENTS 6,540,300 B2 * 4/2003 Piretti ..... A47C 1/03 297/411.35
9,345,333 B2 * 5/2016 Gorgi ..... A47C 1/0307
10,932,575 B2 * 3/2021 Masunaga ..... A47C 7/543

* cited by examiner

*Primary Examiner* — Sarah B McPartlin

(57) ABSTRACT

An armrest structure includes a main base tube, an outer base tube, a control member, and a spring, and the control member includes a pivot part, a press control part, a fastening part, and a restraining part, when the press control part of the control member is pressed, the spring is pushed to store elastic energy, and the fastening part of the control member can be released from being engaged with the main base tube, and the outer base tube can be adjusted to longitudinally lift; in the other hand, when the force applied on the press control part of the control member to press and buckle is removed, the fastening pan can be engaged with the main base tube, so that the outer base tube is unable to lift and move relative to the main base tube.

7 Claims, 13 Drawing Sheets

ARMREST STRUCTURE WITH ADJUSTABLE LIFTING FUNCTION

BACKGROUND OF THE INVENTION

1. Field of the Invention

The present invention relates to a technical field of chair seat, and more particularly to an armrest structure which provides a sitting user to rest hand easily, the key concept of the present invention is to use simple assembly structures to allow the user to quickly adjust the armrest to a comfort rest position for hand by a simple and convenient manner.

2. Description of the Related Art

For ordinary people sitting on a chair tor a long time for operation or office work, the most important thing is the comfort of silting for a long time, and important consideration is the placement of the hands, so some chairs are equipped with armrests in both sides for the sitting users to place and rest hands. However, due to the difference in arm lengths, users may have different requirements in the armrests for resting hands. Therefore, most manufacturers develop the armrests with adjustable lifting structures; that is, the user can adjust a height and a pivot angle of the armrest according to the arm length thereof, so that different users can rest and place their hands in the most comfortable way. However, in recent years, conventional chairs with adjustable armrests on the market are too complicated and cause high cost of maintenance.

In order to solve above-mentioned problems, the inventors spend time in researching relevant knowledge, comparing the advantages and disadvantages of various structures, and performing many experiments and tests, to develop an armrest structure with an adjustable lifting function.

SUMMARY OF THE INVENTION

An objective of the present invention is to improve the existing commercially available armrest and use simple assembly structure to achieve the adjustable effect without adding cost in maintenance, so as to solve the conventional problems. In order to achieve the objective and effect, the present invention provides an armrest structure with the adjustable lifting function, and the armrest includes a main base tube, an outer base tube, a control member and a spring. The main base tube has an end assembled to a chair, other end upwardly extended, a plurality of positioning holes formed on a side of the other end thereof, a guide hole formed on a side of thereof opposite to the plurality of positioning holes, and an accommodation channel formed on the other end thereof upwardly extended. The positioning hole and the guide hole are in communication with the accommodation channel, and a top of the accommodation channel is open. Tire outer base tube is slidably assembled on an outer side of the other end of the main base tube upwardly extended. The outer base tube includes an outer rube part and a cushion part, the outer tube part is slidably disposed around the other end of the main base tube upwardly extended, and tire cushion part is connected to tire outer tube part and in non-parallel with the main base tube, the outer tube part is slidable relative to the main base tube to drive the cushion pan to lift, the outer tube part has an opening formed on a part thereof connected to the cushion part, the outer tube part and the cushion part of the outer base tube are detachable from each other, the outer tube part is a hollow tube body, and the outer tube part has two support plates protruded thereon and correspondingly to the pivot part of the control member, the two support plates are arranged in interval, each of the two support plates has an arc notch recessed on a top thereof and the opening corresponds in position to the two support plate. The control member has an end mounted in the accommodation channel of the main base tube, and other end protruded out of the accommodation channel. The control member includes a pivot part, a press control part, a fastening part, and a restraining part the control member is pivotably assembled on an inner wall of the outer tube part by the pivot part thereof, and the press control part is disposed opposite to the pivot part and protruded out of the opening, and the fastening part is inserted into any one of the plurality of positioning holes in a normal condition, the restraining part is located opposite to the fastening part, and located out of the guide hole in the normal condition. In a condition other than the normal condition, the press control pan is inwardly pressed into and buckled with the outer base tube, to drive the fastening part to release from being inserted into the corresponding one of the plurality of positioning holes, and the restraining pail is engaged into and restrained in the guide hole, wherein the control member has a groove recessed in a top surface thereof and between the pivot part and the press control part, and a positioning rod perpendicularly protruded on a bottom of the groove. The spring is mounted on the positioning rod, two ends of the spring are elastically pushed against the bottom of the groove and the cushion part, respectively, and when the press control pan of the control member is pressed toward and buckled with the outer base tube, the spring is pushed to elastically deform to store elastic energy, and when the force applied on the press control pan to buckle and press is released, an end of the spring storing elastic energy elastically pushes the press control pan toward the opening to reset position.

BRIEF DESCRIPTION OF THE DRAWINGS

The structure, operating principle and effects of the present invention will lie described in detail by way of various embodiments which are illustrated in the accompanying drawings.

DETAILED DESCRIPTION OF THE PREFERRED EMBODIMENTS

Figure 1:
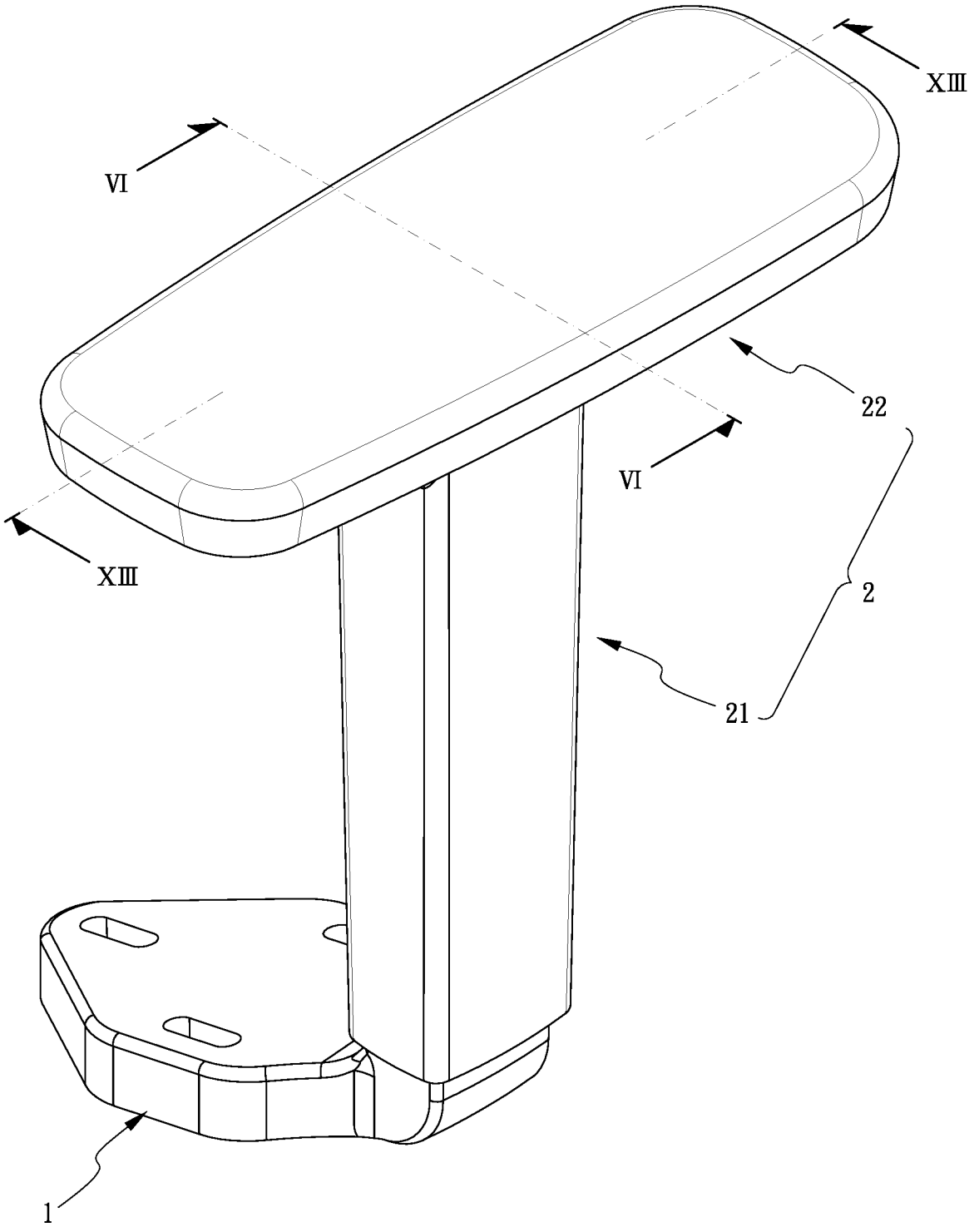
FIG. 1 is a schematic view of an armrest structure with an adjustable lilting function, according to the present invention.

The following embodiments of the present invention are herein described in detail with reference to the accompanying drawings. These drawings show specific examples of the embodiments of the present invention. These embodiments are provided so that this disclosure will be thorough and complete, and will fully convey the scope of the invention to those skilled in the art. It is to be acknowledged that these embodiments are exemplary implementations and are not to be construed as limiting the scope of the present invention in any way. Further modifications to the disclosed embodiments, as well as other embodiments, are also included within the scope of the appended claims. These embodiments are provided so that this disclosure is thorough and complete, and fully conveys the inventive concept to those skilled in the art. Regarding the drawings, the relative proportions and ratios of elements in the drawings may be exaggerated or diminished in size for the sake of clarity and convenience. Such arbitrary proportions are only illustrative and not limiting in any way. The same reference numbers are used in the drawings and description to refer to the same or like parts.

It is to be acknowledged that, although the terms 'first', 'second', 'third', and so on, may be used herein to describe various elements, these elements should not be limited by these terms. These terms are used only for the purpose of distinguishing one component from another component. Thus, a first element discussed herein could be termed a second element without altering the description of the present disclosure. As used herein, the term "or" includes any and all combinations of one or mere of the associated listed items.

It will be acknowledged that when an element or layer is referred to as being "on," "connected to" or "coupled to" another element or layer, it can be directly on connected or coupled to the other element or layer, or intervening elements or layers may be present. In contrast, when an element is referred to as being "directly on," "directly connected to" or "directly coupled to" another element or layer, there are no intervening elements or layers present.

In addition, unless explicitly described to the contrary, the word "comprise" and variations such as "comprises" or "comprising", will be acknowledged to imply the inclusion of stated elements but not the exclusion of any other elements.

Please refer to FIGS. 1 to 13. The armrest structure of the present invention includes a main base tube 1, an outer base tube 2, a control member 3 and a spring 4. The main base tube 1 has an end assembled to a chair (net shown in figures) and other end upwardly extended, a plurality of positioning holes 11 formed on a side of the other end thereof, and a guide hole 12 formed on a side of thereof opposite to the plurality of positioning holes 11, and an accommodation channel 13 being hollow and formed in the end of the main base tube 1 upwardly extended. The positioning hole 11 and the guide hole 12 are in communication with the accommodation channel 13, the top of the accommodation channel 13 is open. The outer base tube 2 is T-shaped and slidably assembled on an outer side of the end of the main base tube 1 upwardly extended. The outer base tube 2 includes an outer tube pan 21 and a cushion part 22, and the outer tube part 21 is disposed around the main base tube 1 and slidable relative to the end of the main base tube 1 upwardly extended; the end of the cushion part 22 connected to the outer tube part 21 is disposed in non-parallel with the main base tube 1, the cushion part 22 is mainly used to provide a user to rest an arm, and the outer tube part 21 is slidable relative to the main base tube 1, to drive the cushion part 22 to lift. The outer tube part 21 has an opening 23 formed on a part thereof connected to the cushion part 22.

The control member 3 has an end mounted in the accommodation channel 13 of the main base tube 1, and other end protruded out of the accommodation channel 13 and assembled in the outer base rube 2; the control member 3 can include a pivot part 31, a press control part 32, a fastening part 33, and a restraining part 34; the pivot part 31 of the control member 3 is pivotably assembled on an inner wall of the outer tube part 21, and the press control part 32 is disposed opposite to the pivot part 31 and protruded out of the opening 23, and the fastening part 33 is inserted into any one of the plurality of positioning holes 11 in a normal condition; the restraining part 34 is disposed opposite to the fastening part 33, and located out of the guide hole 12 in the normal condition. In a condition other than the normal condition, the press control part 32 is inwardly pressed into and buckled with the outer base tube 2, to drive the fastening part 33 to release from being inserted into the positioning hole 11, and the restraining part 34 is engaged into and restrained in the guide hole 12. The key feature of the control member 3 is that the control member 3 has a groove 37 recessed on a top surface thereof and between the pivot part 31 and the press control part 32, and a positioning rod 371 perpendicularly protruded on a groove bottom of the groove 37. The spring 4 is mounted in the positioning rod 371, and two ends of the spring 4 are used to elastically push the groove bottom of the groove 37 and the cushion part 22, respectively. The press control part 32 of the control member 3 can be inwardly pressed toward and buckled with the outer base tube 2 to push an end of the spring 4 to elastically deformed for elastic energy storage; when live force applied on the press control part 32 to buckle and press is released, the end of the spring 4 storing elastic energy elastically pushes the press control part 32 toward the opening 23 to reset position.

Figure 7:
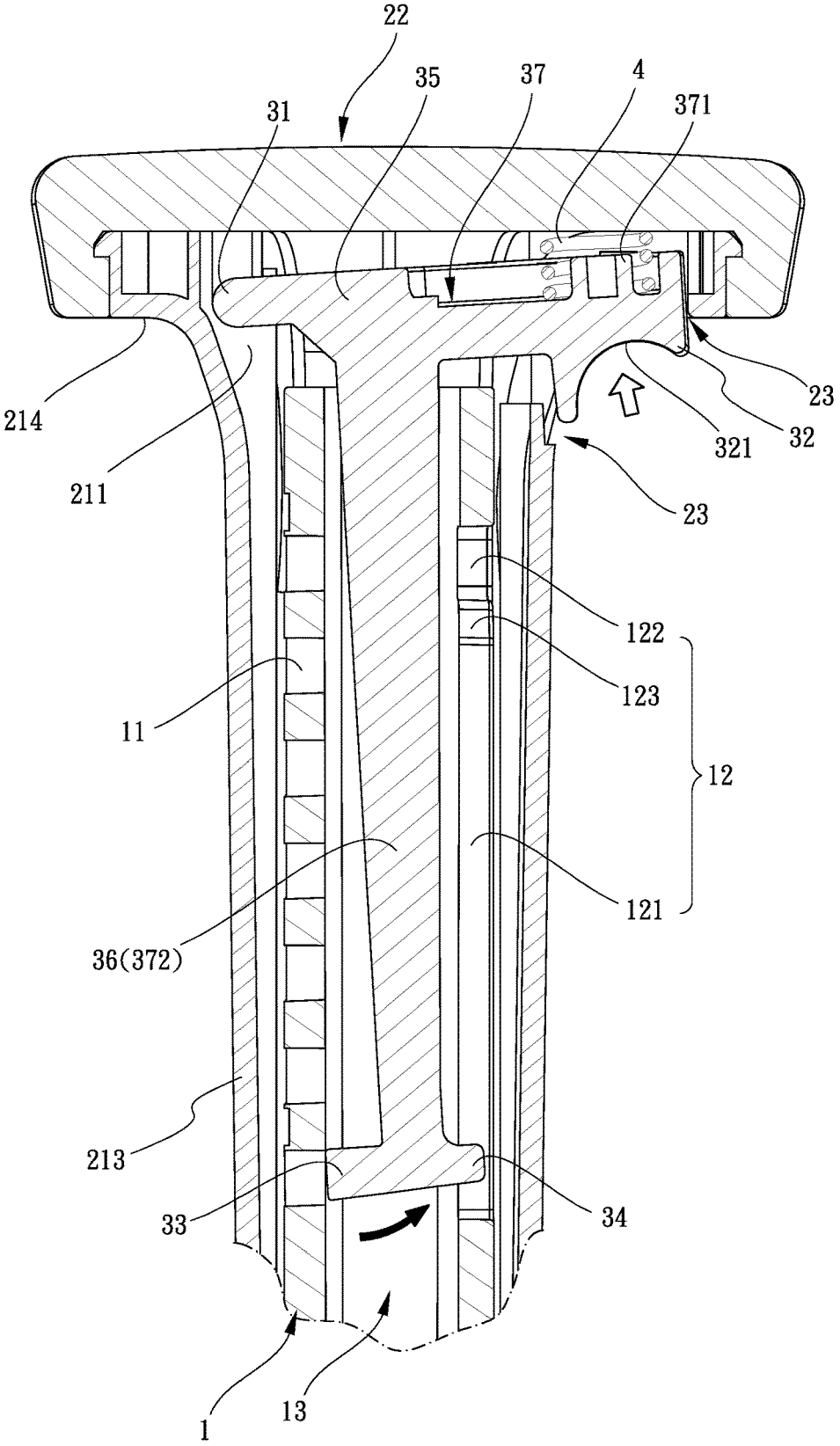
FIG. 7 is a schematic view showing a releasing operation according FIG. 6.
Figure 8:
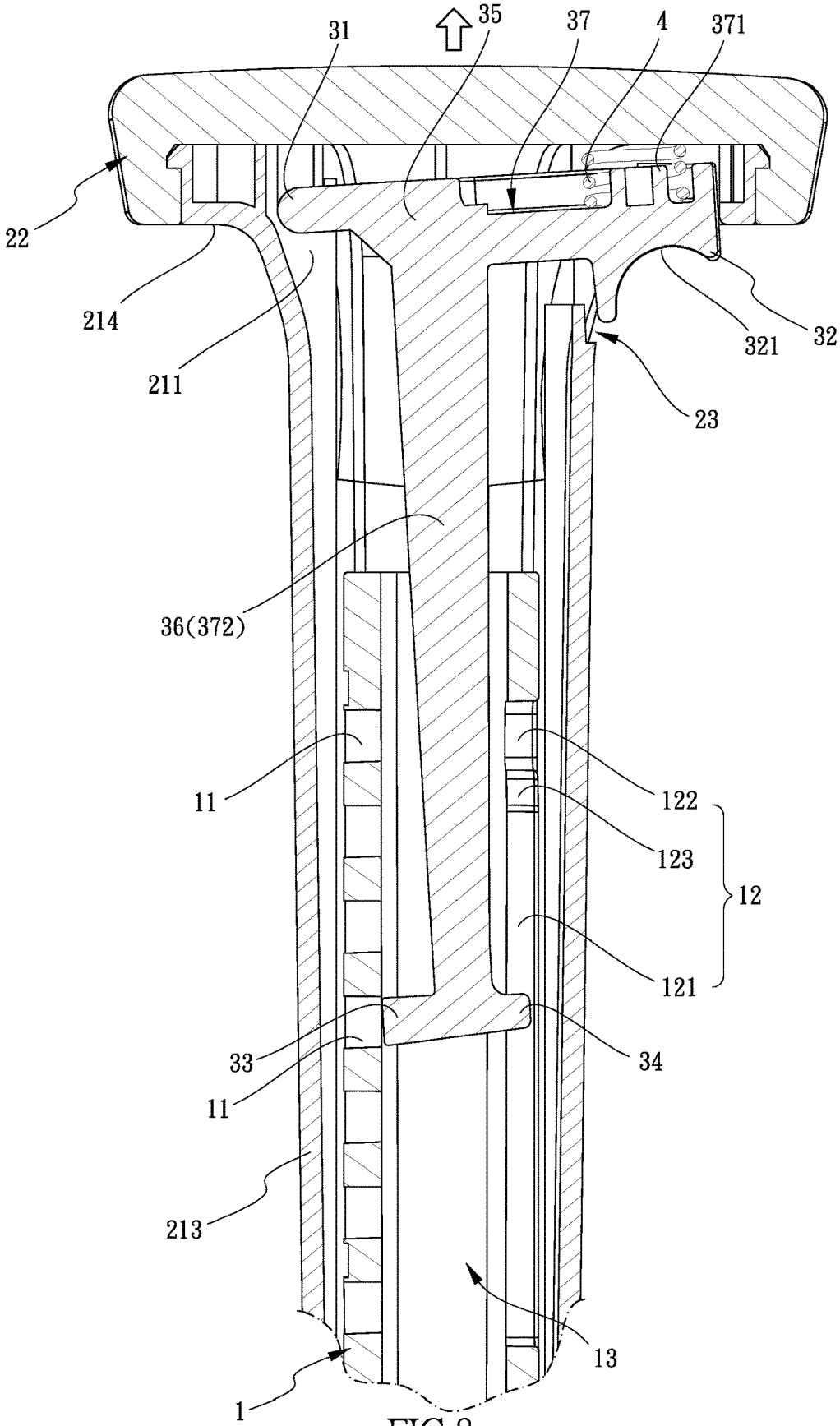
FIG. 8 is a schematic view showing a pulling operation according FIG. 7.

According to aforementioned contents, the operations of the present invention can be separated into an adjusting status and a positioning status. First, in the adjusting status, the fastening part 33 is inserted into the corresponding one of the positioning holes 11 in a normal condition, and when the user wants to ad just the position of the outer base tube 2, the user can just press the press control part 32 by hand (as shown by a hollow arrowhead in FIG. 7); since the pivot part 31 is pivotably assembled with the outer base tube 2, the pressed press control part 32 is swung about the pivot part 31 and toward the cushion part 22, and left and right by about 15 degrees to 25 degrees; furthermore, when the press control part 32 is swung, the spring 4 is pushed to elastically deform to store elastic energy; at the same time, when the press control part 32 is swung, the fastening part 33 is separated from the positioning hole 11 and the restraining part 34 is inserted into the guide hole 12 (as shown by a solid arrowhead in FIG. 7), so the outer base tube 2 can be adjusted in height position relative to the main base tube 1 upwardly or downwardly (as shown by a hollow arrowhead in FIG. 8) after the fastening part 33 is released from being inserted into and engaged with the positioning hole 11; at this time, the press control part 32 is still in the status of being pressed and the control member 3 is also moved along with the outer base tube 2, as shown in FIGS. 7 and 8. In the positioning status, alter the user adjusts the outer base tube 2 to the desired position, the user can release the fastening part 33 from being pressed (as shown by a hollow arrowhead in FIG. 9), after the pressing force is removed, the spring 4, which is elastically deformed to store elastic energy by the user's force, can push the press control part 32 toward the opening 23 to reset position by the elastic force. After the press control part 32 is reset, the fastening pan 33 is inserted into the corresponding one of the positioning hole 11 (as shown by a solid arrowhead in FIG. 9), and at the same time, the restraining part 34 is moved away from the guide hole 12. As a result, the positioning operation is completed after the adjusting operation.

Figure 2:
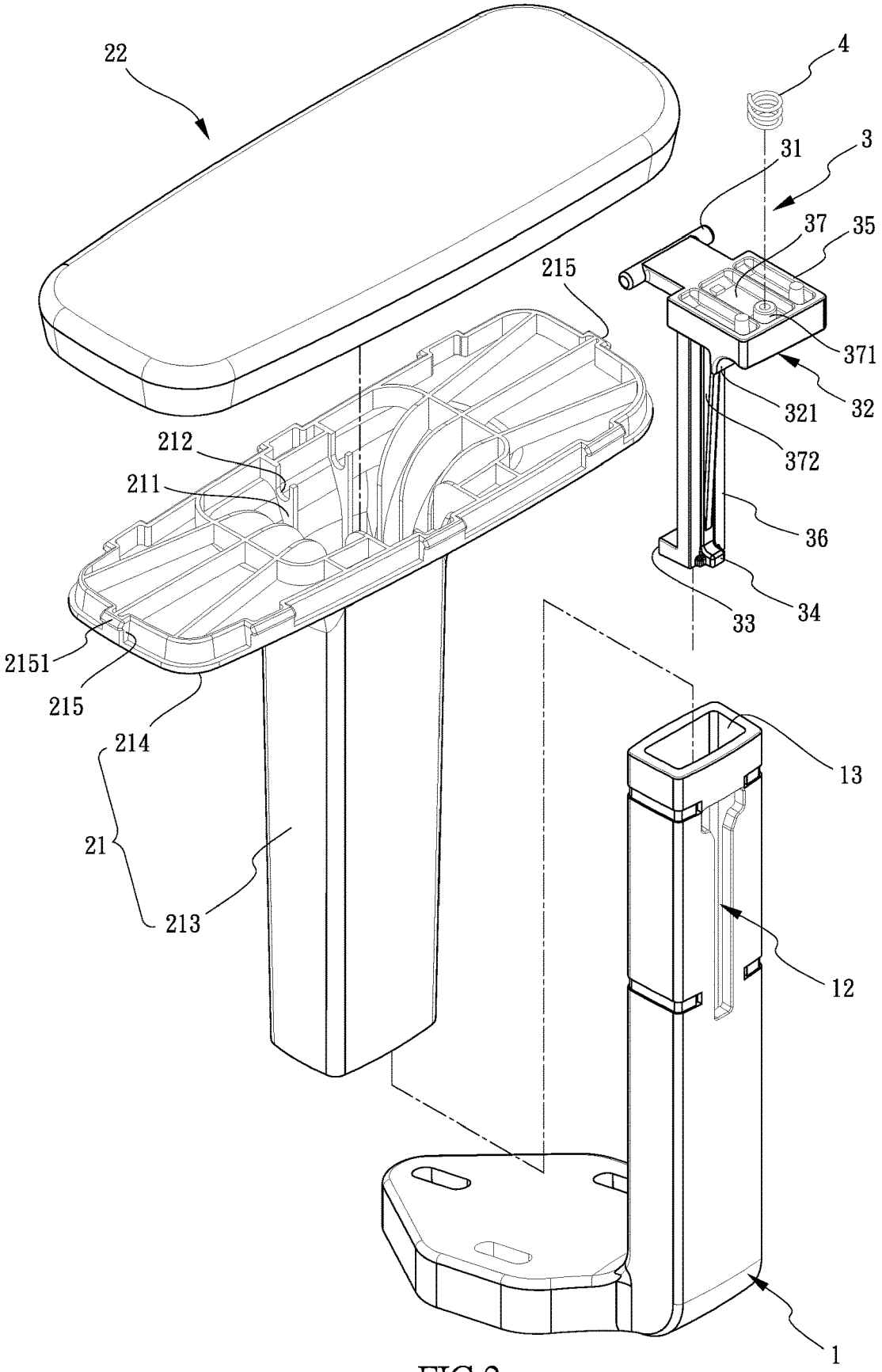
FIG. 2 is a perspective exploded view of an armrest structure with the adjustable lifting function, according to the present invention.

According to aforementioned contents, as shown in FIG. 2, the outer tube part 21 and the cushion part 22 of the outer base tube 2 are detachable from each other, the outer tube part 21 is a hollow tube body, and the outer tube part 21 has two support plates 211 protruded thereon and correspondingly to the pivot part 31 of the control member 3, the two support plates 211 are arranged in interval, and each of the two support plates 211 has an arc notch 212 recessed on a top thereof. The opening 23 corresponds in position to the two support plates 211. The pivot part 31 is in a cylinder shape and mounted on the arc notches 212 of the two support plates 211, the two support plates 211 are provided to combine with the pivot part 31 of the control member 3, so that the control member 3 is pivotally swingable about the pivot part 31. Furthermore, the outer tube part 21 of the outer base tube 2 can be divided into a peripheral plate 213 and a bottom base 214, the peripheral plate 213 is disposed around to the main base tube 1, and the bottom base 214 is formed with the peripheral plate 213 integrally and disposed on the end of the peripheral plate 213, and has at least one engaging member 215 protruded on a peripheral side thereof; the cushion part 22 has an assembly groove 221 recessed on a bottom surface thereof, and a buckling part 222 disposed on a sidewall thereof and corresponding in position to the at least one engaging member 215 on the peripheral side of the bottom base 214. When the cushion part 22 is mounted in the outer tube part 21, the bottom base 214 is inserted into the assembly groove 221, and the engaging members 215 are buckled and assembled with the corresponding buckling parts 222, respectively. Please refer to FIGS. 11 to 13. For assembly of the cushion part 22 and the bottom base 214, an engaging member 215 on any one of the peripheral side of the bottom base 214 is horizontally extended outwardly, and each of the engaging members 215 is a fan-shaped pin and has an upper incline 2151; therefore, the cushion part 22 is engaged with the horizontally-extended engaging member 215 first, and the cushion pan 22 is then swung to pivotally and slidably mount on the outer periphery of the bottom base 214 along the upper incline 2151 of the another engaging member 215. The upper incline 2151 can facilitate the cushion part 22 to downwardly press and buckle smoothly, so that the another engaging member 215 can be buckled and assembled with the corresponding buckling part 222, and above-mentioned manner can provide the user to assemble the cushion part 22 with the bottom base 214 easily and quickly.

Figure 9:
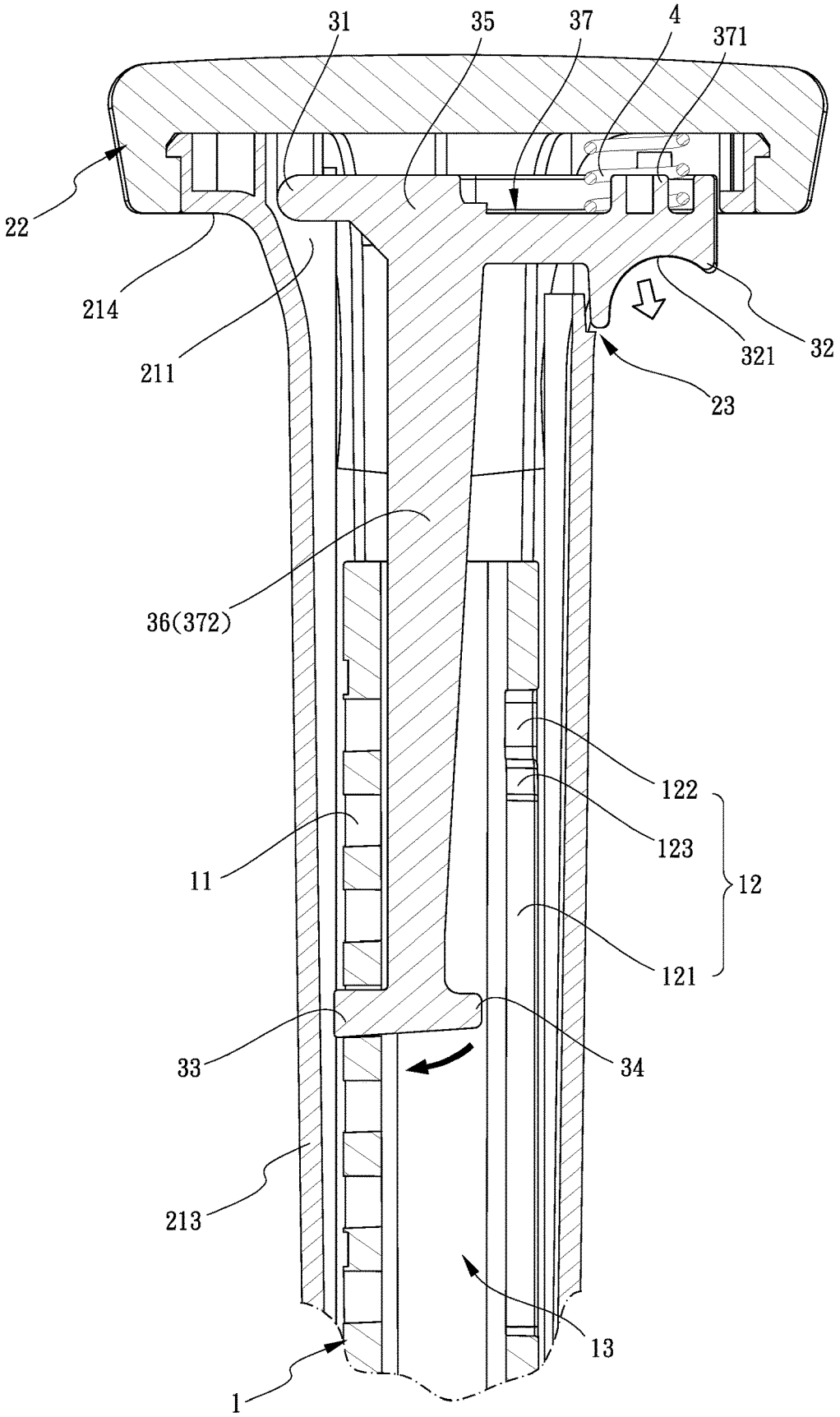
FIG. 9 is a schematic view showing a releasing operation according FIG. 8.
Figure 10:
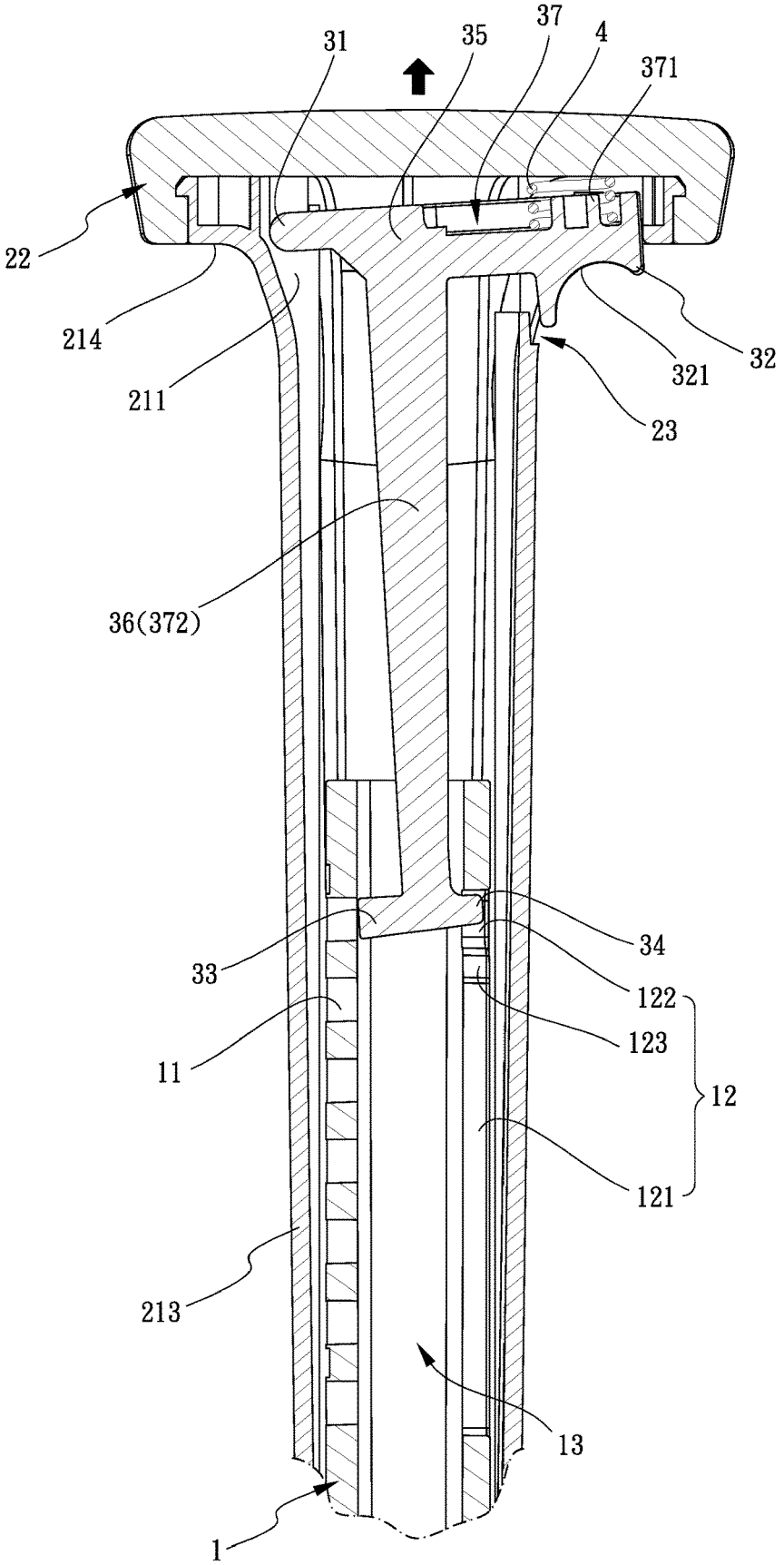
FIG. 10 is a schematic view showing an operation of pulling the outer base tube to the top according to the present invention.
Figure 11:
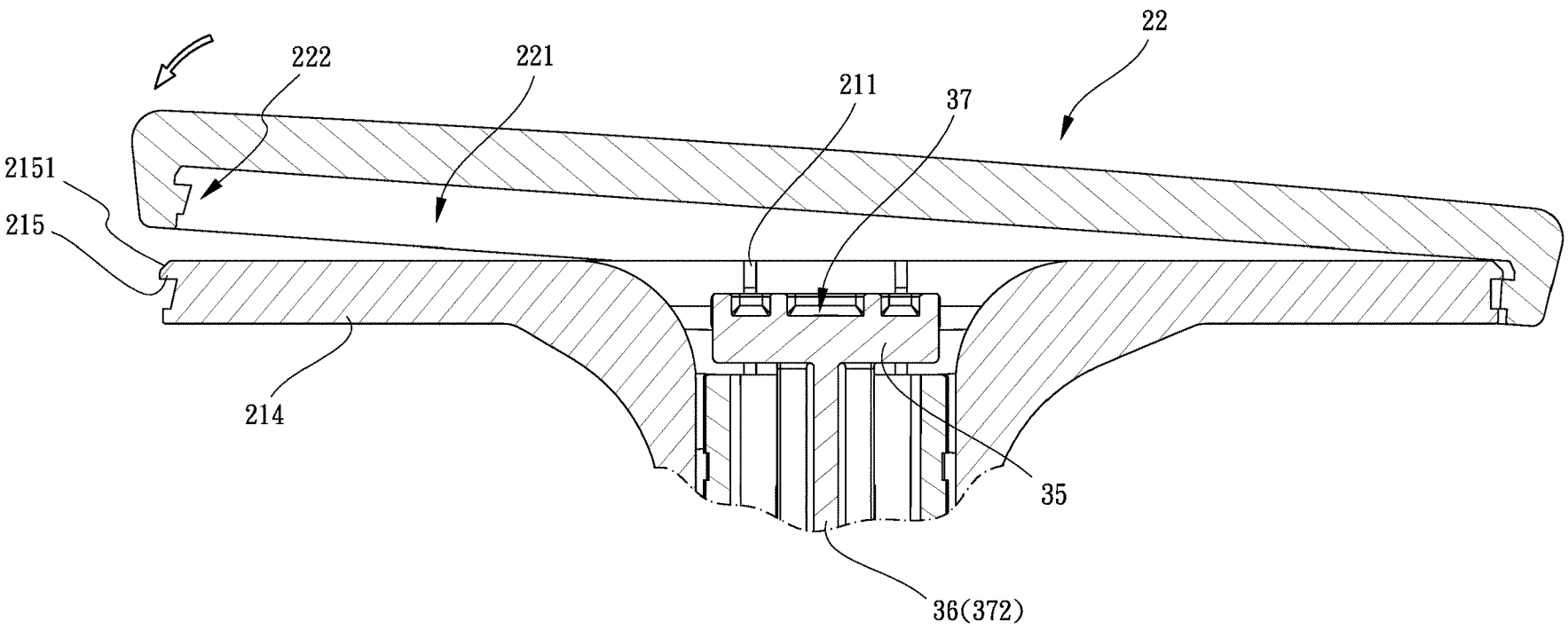
FIGS. 11 and 12 are schematic views continuously showing an operation of engaging a buckling part on a cushion part, according to the present invention.
Figure 12:
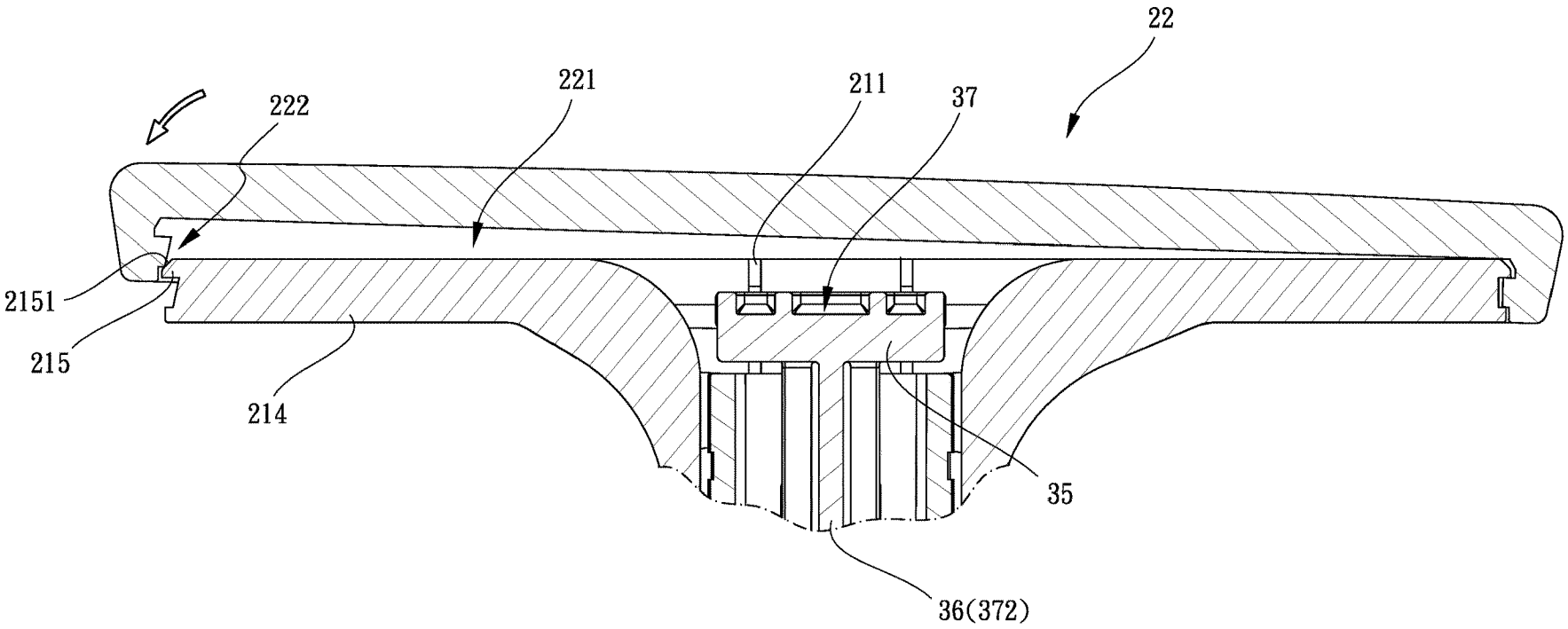
Figure 13:
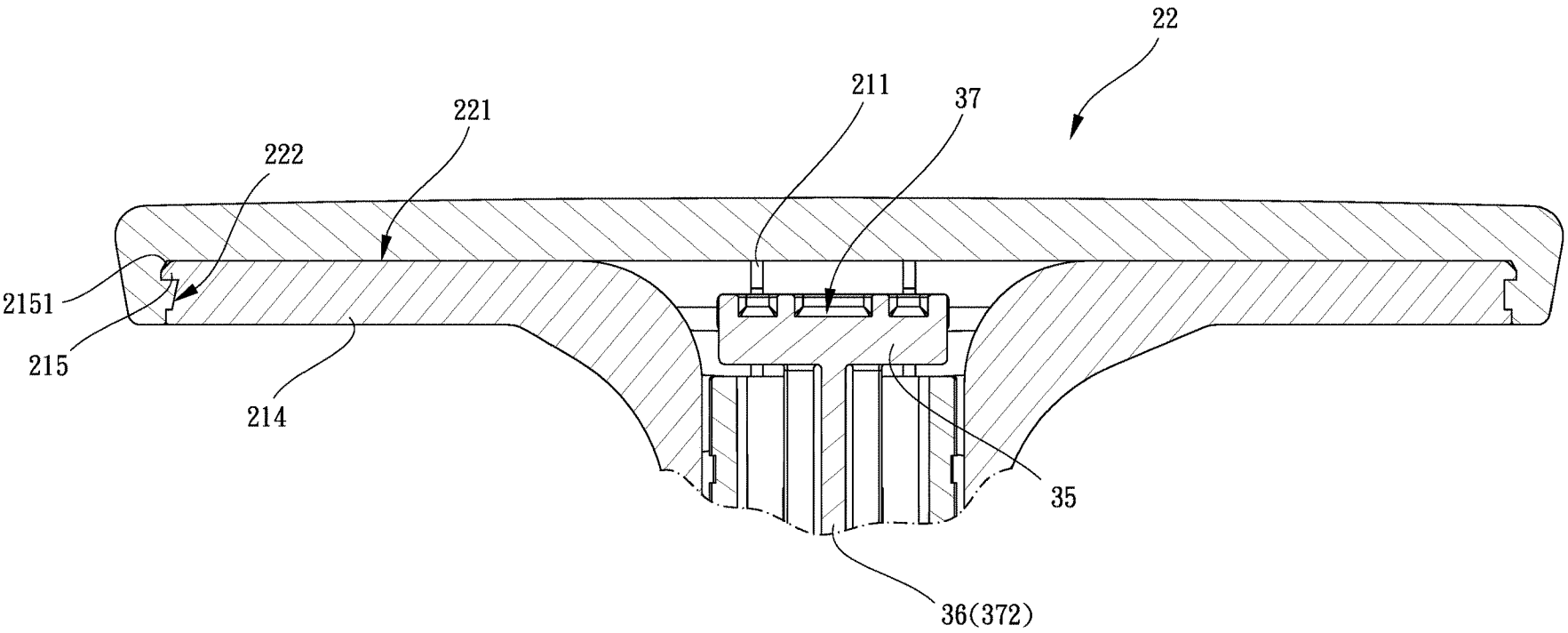
FIG. 13 is a schematic cross-sectional view taken along VIII-VIII of FIG. 1.

The control member 3 is T-shaped and includes a horizontal section 35 and a vertical section 36; the vertical section 36 and the horizontal section 35 are perpendicularly connected to each other, and the vertical section 36 is slidably disposed in the end of the main base tube 1 upwardly extended, and the pivot part 31 and the press control part 32 are the two end parts of the horizontal section 35. Tire vertical section 36 has a rib 372 extended from a position near the restraining part toward the horizontal section and gradually becoming outwardly thicker, and the rib 372 supports the connection between the horizontal section 35 and the vertical section 36, the fastening part 33 and the restraining part 34 are disposed on end of the vertical section 36 and correspond in position to the positioning hole 11 and guide hole 12. The control member 3 is pivotally swingable about the pivot part 31, and when the press control part 32 is inwardly pressed toward and buckled with the cushion part 22, the horizontal section 35 is swung to push the spring 4 to deform for elastic energy storage, and the horizontal section 35 is also swung to drive the vertical section 36 to swing, so that the fastening part 33 disposed on the vertical section 36 is released from being inserted into the positioning hole 11, and the restraining part 34 can be slid along the guide hole 12 to lift the outer base tube 2, as shown in FIGS. 7 to 9 with reference to FIGS. 2 and 3.

Figure 3:
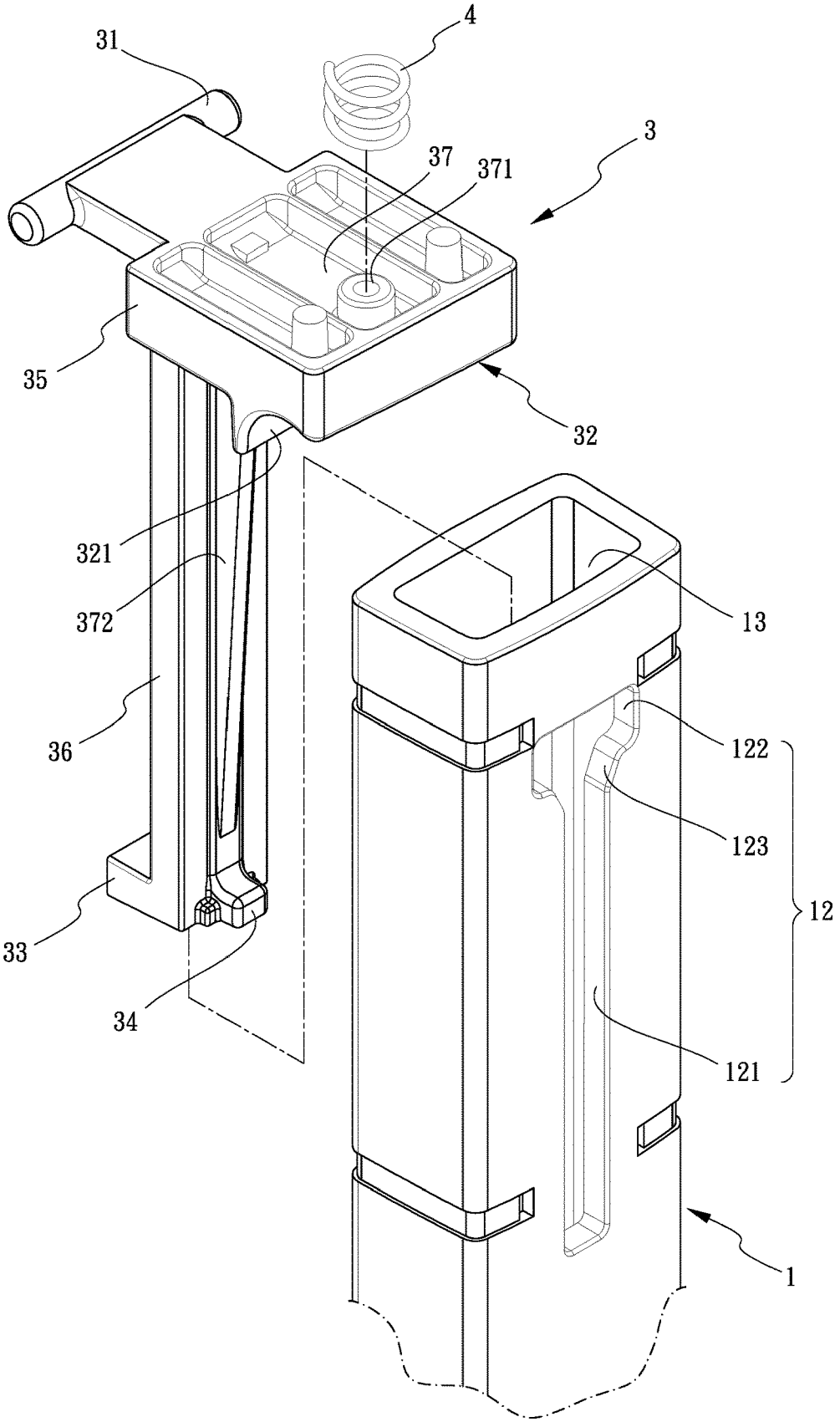
FIG. 3 is a schematic view of a part of FIG. 2.

In order to facilitate the manufacturer to assemble conveniently, the guide hole 12 can be divided into a sliding section 121 and a transition section 122, and the sliding section 121 is in communication with the transition section 122, and the transition section 122 is closer to and spaced apart from the end surface of the main base tube 1 by a certain distance. The transition section 122 has a wide diameter larger than that of the sliding section 121, and the guide hole 12 has a T shape. Furthermore, two curved guiding corners 123 are formed on the connection between the sliding section 121 and the transition section 122, and the two curved guiding corners 123 correspond in position to each other. When the manufacturer needs to insert the vertical section 36 of the control member 3 into the main base tube 1, the restraining pan on the end of the vertical section 36 can be slid into the transition section 122 first without being required in alignment because of the larger wide diameter of the transition section 122, and the curve profiles of tire two curved guiding corner 123 can be used to guide the position-limiting pan 34 into the sliding section 121, so that the manufacturer can assemble the control member 3 and the main base tube 1 more conveniently, as shown in FIG. 3.

Figure 4:
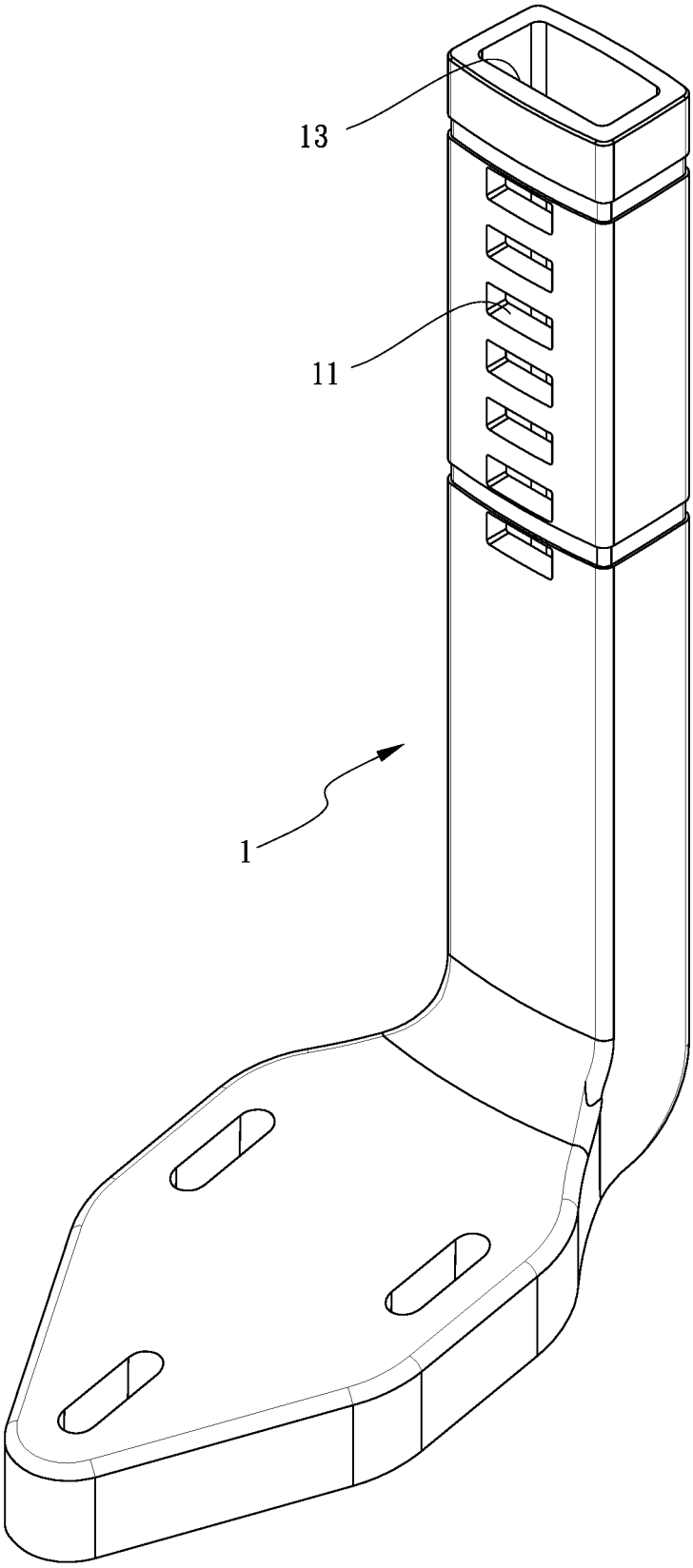
FIG. 4 is a perspective view of a main base tube of the present invention, when viewed from another angle.
Figure 5:
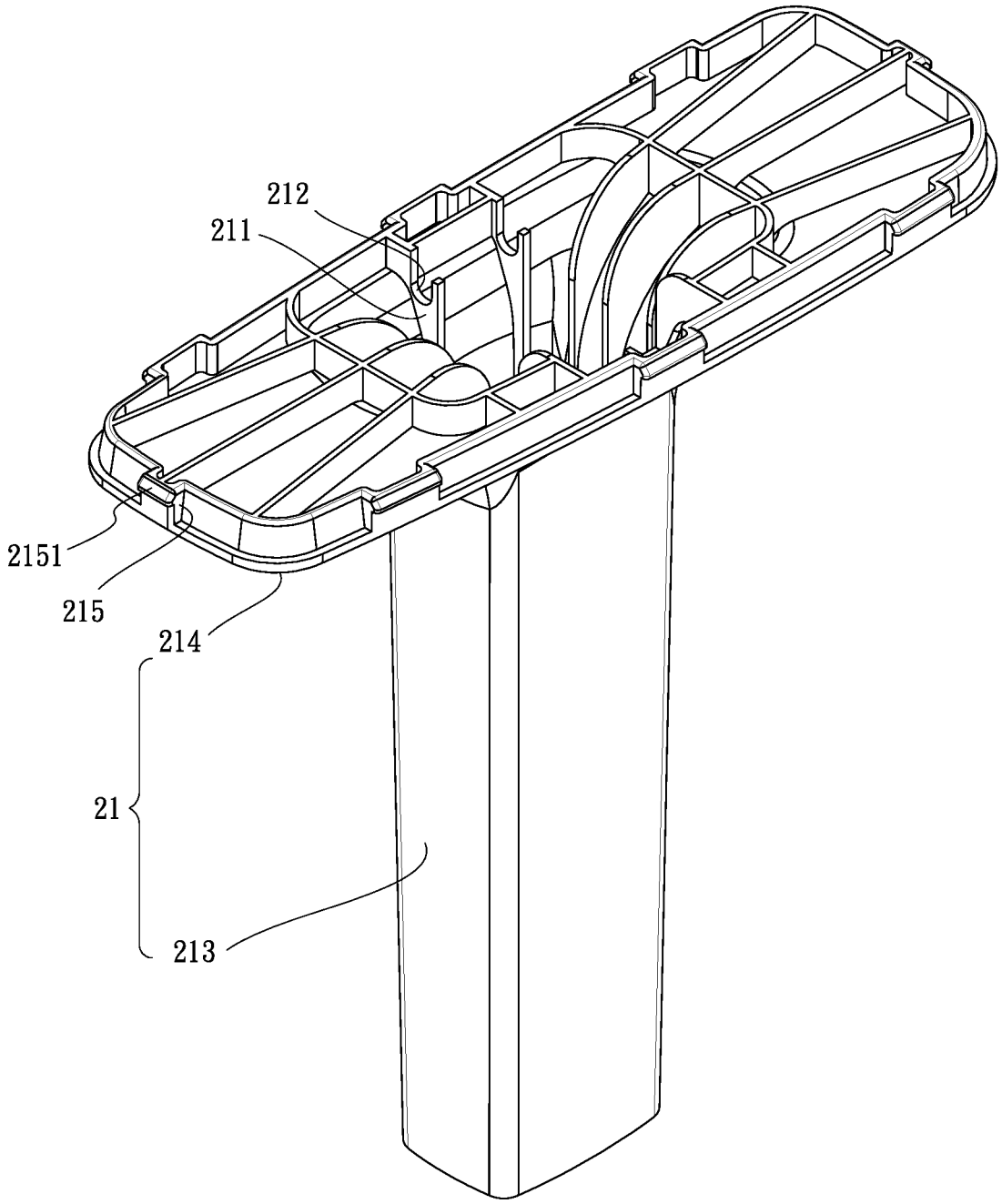
FIG. 5 is an enlarged schematic view of a part of a bottom base of an outer base tube of the present invention.
Figure 6:
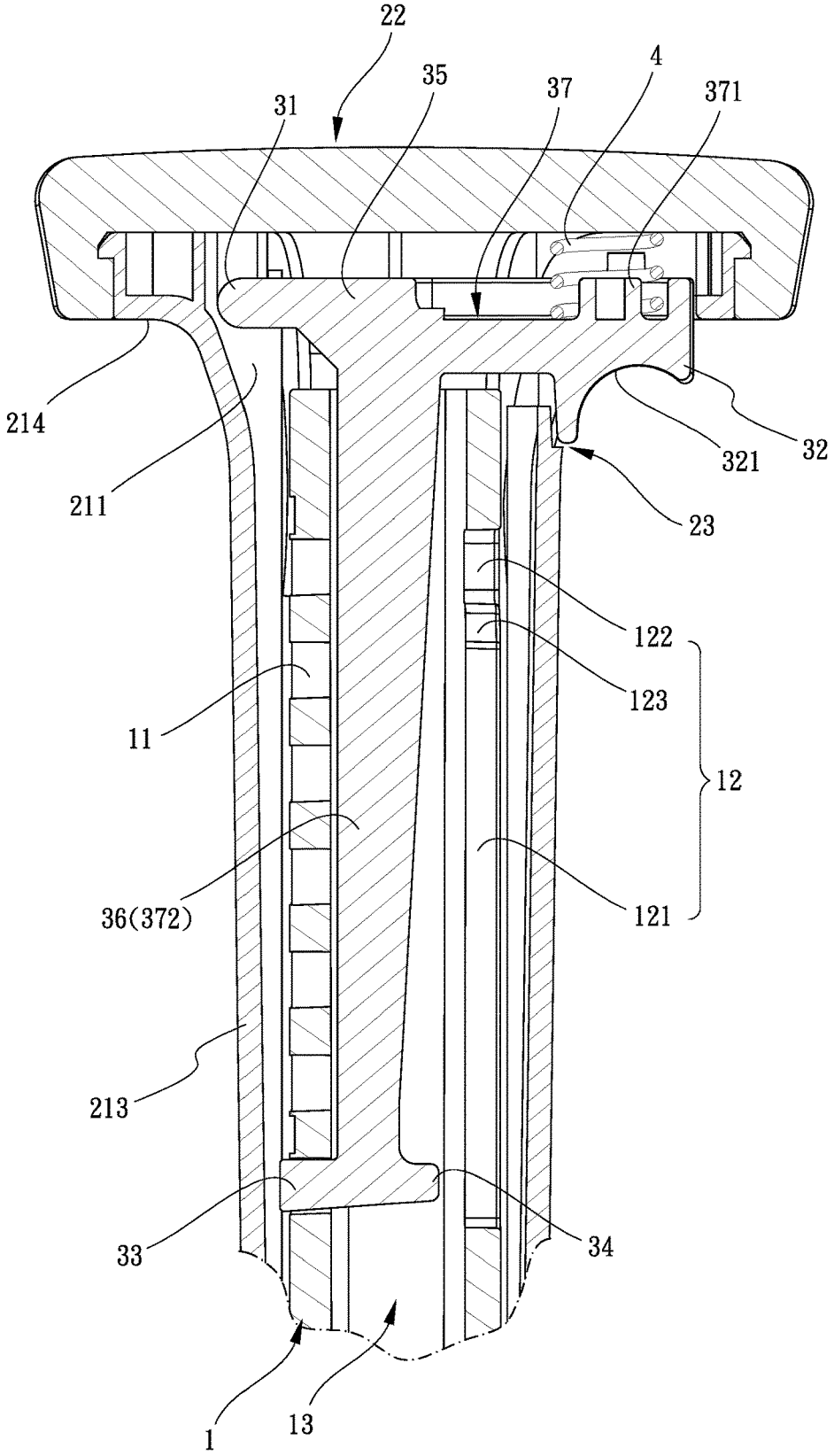
FIG. 6 is a schematic cross-sectional view taken along VI-VI of FIG. 1.

It is worth noting that in order to facilitate the user to find the position of the press control pan 32 of the control member 3 and use and operate the armrest easily, the press control part 32 has an arc groove 321 recessed on a bottom surface thereof, the user can drive the arc groove 321 to control and drive the press control part 32 to protrude out of the opening 23 of the outer base tube 2 or swing inside the opening 23 of the outer base tube 2; therefore, the user just needs to grope the bottom of the bottom base 214 by hand, and upwardly press in the arc direction when touching the arc groove 321, so as to use the armrest of the present invention conveniently and easily, as shown in FIGS. 2 and 4.

The present invention disclosed herein has been described by means of specific embodiments. However, numerous modifications, variations and enhancements can be made thereto by those skilled in the art without departing from the spirit and scope of the disclosure set forth in the claims.

What is claimed is:

1. An armrest structure with an adjustable lifting function, comprising:

a main base tube having an end assembled with a chair, other end upwardly extended, a plurality of positioning holes formed on the other end thereof, a guide hole formed on a side of thereof opposite to the plurality of positioning holes, and an accommodation channel formed on the other end thereof upwardly extended and in communication with the plurality of positioning holes and the guide hole, wherein a top of the accommodation channel is open;

an outer base tube slidably assembled on an outer side of the other end of the main base tube upwardly extended, and comprising an outer tube part and a cushion part, wherein the outer tube part is slidably disposed around the other end of the main base tube upwardly extended, and the cushion part is connected to the outer tube part and a length direction of the cushion part is in non-parallel with the other end of the main base tube upwardly extended, the outer tube part is slidable relative to the main base tube to drive the cushion part to lift, the outer tube part has an opening formed on a part thereof connected to the cushion part, the outer tube part and the cushion part of the outer base tube are detachable from each other, the outer tube part is a hollow tube body;

a control member having an end mounted in the accommodation channel of the main base tube, and other end protruded out of the accommodation channel, wherein the control member comprises a pivot part, a press control part, a fastening part and a restraining part, the control member is pivotably assembled on an inner wall of the outer tube part by the pivot part thereof, and the press control part is disposed opposite to the pivot part and protruded out of the opening, and the fastening part is inserted into any one of the plurality of positioning holes in a normal condition, the restraining part is located opposite to the fastening part and located out of the guide hole in the normal condition, wherein in a condition other than the normal condition, the press control part is inwardly pressed into the outer base tube, to drive the fastening part to release from being inserted into one of the plurality of positioning holes, and the restraining part is engaged into and restrained in the guide hole, wherein the outer tube part has two support plates protruded thereon and correspondingly to the pivot part of the control member, the two support plates are spaced apart to each other, each of the two support plates has an arc notch recessed on a top thereof, and the opening corresponds in position to the two support plates, wherein the control member has a groove recessed in a top surface thereof and between the pivot part and the press control part, and a positioning rod perpendicularly protruded on a bottom of the groove; and a spring mounted on the positioning rod and has two ends elastically pushed against the bottom of the groove and the cushion part, respectively, wherein when the press control part of the control member is inwardly pressed toward and buckled with the outer base tube, the press control part pushes the end of the spring to elastically deform the spring to store elastic energy, and when the force applied on the press control part is released, the end of the spring storing elastic energy elastically pushes the press control part toward the opening to reset position.

2. The armrest structure according to one of claim 1, wherein the control member is T-shaped and comprises a horizontal section and a vertical section, the vertical section and the horizontal section are perpendicularly connected to each other, the vertical section is slidably disposed on the other end of the main base tube upwardly extended, and the pivot part and the press control part are two end parts of the horizontal section, the fastening part and the restraining part are disposed on an distal end of the vertical section and correspond in position to the plurality of positioning holes and the guide hole, respectively, and the control member is pivotally swingable about the pivot part, wherein when the press control part is inwardly buckled and pressed toward the cushion part of the outer base tube, the horizontal section is swung to push the spring to deform and store elastic energy, and also drive the vertical section to swing, so that the fastening part disposed on the vertical section is released from being inserted into one of the plurality of positioning holes, and the restraining part is slid along the guide hole when the outer base tube is adjusted to lift.

3. The armrest structure according to claim 2, wherein the guide hole is divided into a sliding section and a transition section, and the sliding section is in communication with the transition section, and the transition section is closer to an end surface of the main base tube, the transition section has a wide diameter larger than that of the sliding section, and two curved guiding corners are formed on a connection between the sliding section and the transition section, and the two curved guiding corners correspond in position to each other, and in a process of inserting the vertical section of the control member into the main base tube, the restraining part on the end of the vertical section is slid into the transition section, and curve profiles of the two curved guiding corner are used to guide a position-limiting part into the sliding section.

4. The armrest structure according to claim 3, wherein the vertical section has a rib extended from a position near the restraining part toward horizontal section and gradually becoming outwardly thicker, and the rib is configured to support the connection between the horizontal section and the vertical section.

5. The armrest structure according to claim 1, wherein the outer tube part of the outer base tube is divided into a peripheral plate and a bottom base, the peripheral plate is disposed around to the main base tube, and the bottom base is formed with the peripheral plate integrally and disposed on an end of the peripheral plate, the bottom base has engaging members respectively protruded on peripheral sides thereof, the cushion part has an assembly groove recessed on a bottom surface thereof, and buckling parts disposed on sidewalls of the assembly groove thereof and corresponding in position to the engaging members on the peripheral sides of the bottom base, and when the cushion part is to be mounted in the outer tube part, the bottom base is inserted into the assembly groove, and the engaging members are buckled and assembled with the buckling parts, respectively.

6. The armrest structure according to claim 5, wherein one of the engaging members on any one of the peripheral sides of the bottom base is outwardly and horizontally extended, and another of the engaging members disposed opposite to the one of the engaging members is a fan-shaped rod having an upper incline, and after the cushion part is engaged with the engaging member horizontally extended, the cushion part is swung to pivotally and slidably mount on the outer periphery of the bottom base along the upper incline of the another of the engaging members, so that another of the engaging members is buckled and assembled with the corresponding one of the buckling parts.

7. The armrest structure according to claim 1, wherein the press control part has an are groove recessed on a bottom surface thereof, when the arc groove is driven, the press control part is controlled and driven to protrude out of the opening of the outer base tube or swing inside the opening of the outer base tube.

* * * * *